US006776665B2

(12) United States Patent
Huang

(10) Patent No.: US 6,776,665 B2
(45) Date of Patent: Aug. 17, 2004

(54) ELECTRICAL CONNECTOR WITH A TRANSPARENT INSULATING JACKET

(75) Inventor: George Ying-Liang Huang, 8F, No. 435, Rei-Kuang Rd., Nei-Hu Dist., Taipei City (TW)

(73) Assignee: George Ying-Liang Huang, Taipei (TW)

( * ) Notice: Subject to any disclaimer, the term of this patent is extended or adjusted under 35 U.S.C. 154(b) by 46 days.

(21) Appl. No.: 10/303,442

(22) Filed: Nov. 25, 2002

(65) Prior Publication Data

US 2004/0102095 A1 May 27, 2004

(51) Int. Cl.[7] ..... H01R 24/00
(52) U.S. Cl. ..... 439/676; 439/610; 439/352
(58) Field of Search ..... 439/676, 668, 439/350, 352, 607–610, 353, 357; 361/818

(56) References Cited

U.S. PATENT DOCUMENTS 4,912,291 A * 3/1990 Hepperle et al. ..... 200/82 E
5,197,900 A * 3/1993 Ellis et al. ..... 439/352
5,430,618 A * 7/1995 Huang ..... 361/818
5,434,415 A * 7/1995 Terada et al. ..... 250/368
6,287,148 B1 9/2001 Huang
6,494,744 B1 * 12/2002 Lee ..... 439/610

* cited by examiner

*Primary Examiner*—J. F. Duverne
(74) *Attorney, Agent, or Firm*—Webb Ziesenheim Logsdon Orkin & Hanson, P.C.

(57) ABSTRACT

A connector unit of an electrical connector includes a terminal set mounted on a terminal holding member. The terminal set has a front mating portion and a rear coupling portion that projects rearwardly relative to a rear end face of the terminal holding member. A tubular unitary metal protective sleeve has a sleeve wall with a front end portion that defines a receiving space for receiving the terminal holding member of the connector unit therein. A transparent insulating jacket encloses fittingly the metal protective sleeve. An interlocking unit includes a hole set formed in one of the sleeve wall and the transparent insulating jacket, and a plug set formed on the other of the sleeve wall and the transparent insulating jacket to interconnect securely the metal protective sleeve and the transparent insulating jacket.

28 Claims, 3 Drawing Sheets

ELECTRICAL CONNECTOR WITH A TRANSPARENT INSULATING JACKET

BACKGROUND OF THE INVENTION

1. Field of the Invention

The invention relates to an electrical connector, such as one that is used to terminate a signal cable, more particularly to an electrical connector with a transparent insulating jacket.

2. Description of the Related Art

An electrical connector is commonly used in computer systems and communication networks. In U.S. Pat. No. 6,287,148, there is disclosed a conventional electrical connector that comprises an insulator body, an annular metal housing, and a tubular unitary metal protective shield. The insulator body has a front face, a rear face, and a terminal pin unit. The terminal pin unit includes a plurality of parallel pins that extend through the insulator body. Each of the pins has a front end that extends from the front face of the insulator body, and a rear end that extends from the rear face of the insulator body. The annular metal housing defines a terminal opening therein, and has a rear end, which is formed with an out wardly extending flange. The metal protective shield has open front and rear ends, which are adapted for passage of a cable through the shield to connect with the rear ends of the pins electrically. The shield defines a hole therein, which has an enlarged front portion for receiving the insulator body fittingly therein. The front end of the metal protective shield is formed with an outwardly extending flange, which abuts against the flange of the housing and which is connected fixedly to the flange of the housing.

Due to the presence of the tubular unitary metal protective shield, the advantages of a reduction in electromagnetic interference without an increase in the complexity of the manufacturing process can be achieved by the aforesaid electrical connector. However, because a rigid insulating housing is injection molded on the shield for protecting the latter, the shield is likely to be inadvertently deformed during the injection molding process, thereby resulting in possible short circuits within the electrical connector. Moreover, because the insulating housing is opaque, it is not possible to verify connections within the electrical connector and to form relief patterns on the shield for identification or aesthetic purposes.

SUMMARY OF THE INVENTION

Therefore, the main object of the present invention is to provide an electrical connector with a transparent insulating jacket in order to overcome the aforementioned drawbacks of the prior art.

According to the present invention, an electrical connector comprises:

a connector unit including a terminal holding member and a terminal set mounted on the terminal holding member, the terminal holding member having a front end face and a rear end face opposite to the front end face, the terminal set having a front mating portion and a rear coupling portion that projects rearwardly relative to the rear end face of the terminal holding member;

a tubular unitary metal protective sleeve having a sleeve wall with a front end portion that defines a receiving space for receiving the terminal holding member of the connector unit therein;

a transparent insulating jacket for enclosing fittingly the metal protective sleeve; and an interlocking unit including a hole set formed in one of the sleeve wall and the transparent insulating jacket and a plug set formed on the other of the sleeve wall and the transparent insulating jacket to interconnect securely the metal protective sleeve and the transparent insulating jacket.

BRIEF DESCRIPTION OF THE DRAWINGS

Other features and advantages of the present invention will become apparent in the following detailed description of the preferred embodiments with reference to the accompanying drawings, of which.

DETAILED DESCRIPTION OF THE PREFERRED EMBODIMENTS

Figure 1:
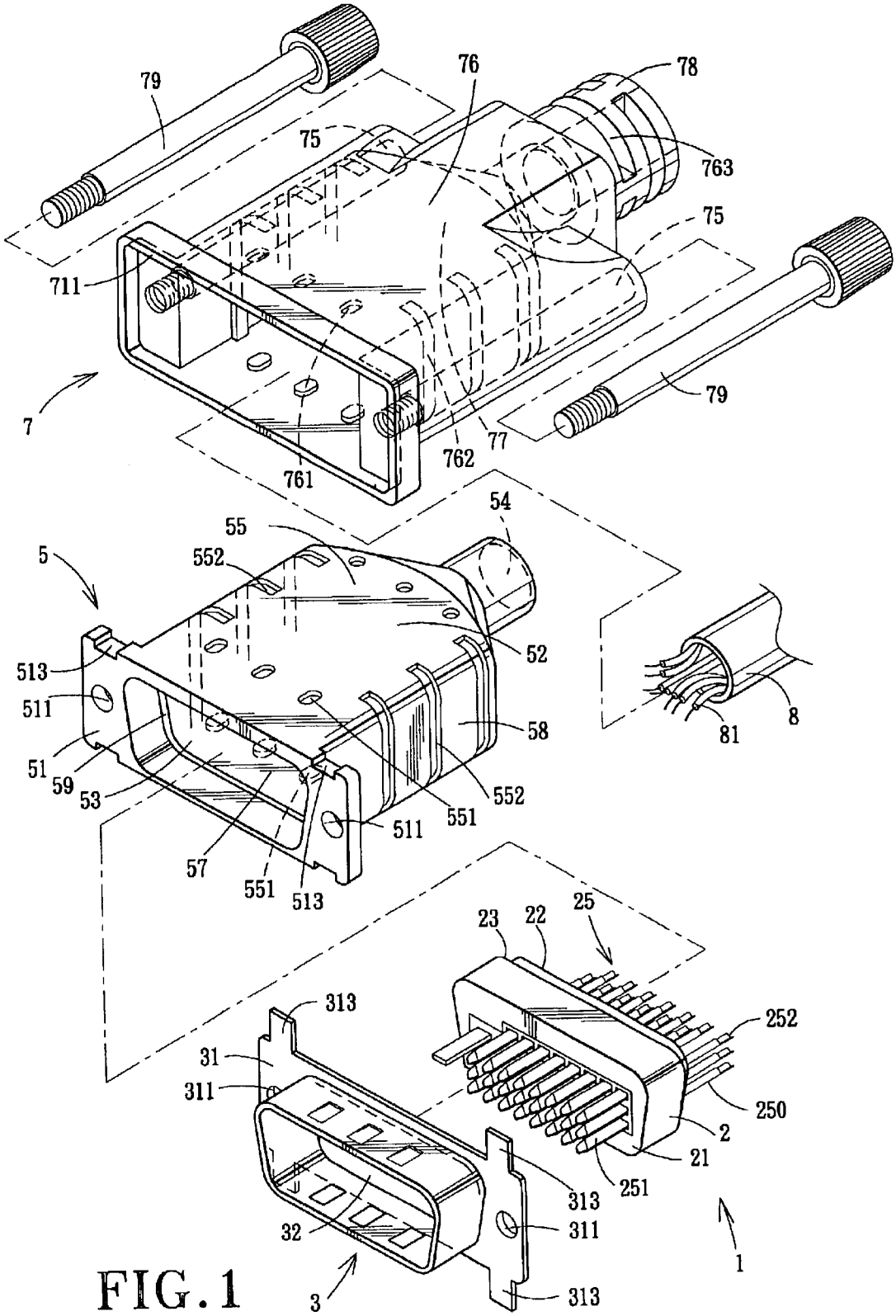
FIG. 1 is an exploded perspective view of the first preferred embodiment of an electrical connector according to this invention.

Referring to FIG. 1, the first preferred embodiment of an electrical connector according to this invention is shown to include a connector unit 1, an annular metal shield 3, and a connector housing that is constituted by a tubular unitary metal protective sleeve 5, a transparent insulating jacket 7, and an interlocking unit.

The connector unit 1 includes a terminal holding member 2 and a terminal set 25. The terminal holding member 2 is made of an insulating material, and has a front end face 21, a rear end face 22 that is opposite to the front end face 21, and a peripheral shoulder 23 formed around the rear end face 22. The terminal set 25 includes parallel pins 250 that extend through the terminal holding member 2. Each of the pins 250 has a front mating portion 251 that projects forwardly relative to the front end face 21 of the terminal holding member 2, and a rear coupling portion 252 that projects rearwardly relative to the rear end face 22 of the terminal holding member 2. The rear coupling portions 252 of the pins 250 are to be connected respectively to signal lines 81 of a signal cable 8 in a conventional manner.

The metal shield 3 defines a terminal opening 32 therein, and is disposed adjacent to the front end face 21 of the terminal holding member 2. The metal shield 3 has a rear end formed with an outwardly extending flange 31. The front mating portions 251 of the pins 250 of the terminal set 25 extend into the terminal opening 32 in the metal shield 3. In this embodiment, the flange 31 is generally rectangular, and is formed with four tongues 313 at four corners thereof.

In this embodiment, the metal protective sleeve 5 is formed integrally using a press casting or injection molding process, and has a sleeve wall with a thickness, which ranges between 0.6 mm and 1.0 mm, to enhance the structural strength of the same. The sleeve wall has a main body segment 52 that includes a top wall part 55, a bottom wall part 57, and a pair of opposite side wall parts 58 which interconnect the top and bottom wall parts 55, 57. In this embodiment, the main body segment 52 has a front end portion 53 that defines a receiving space for receiving the terminal holding member 2 fittingly therein. A shoulder 59 is formed in the receiving space at the front end portion 53 of the main body segment 52 for abutting against the shoulder 23 of the terminal holding member 2. A distal front end of the main body segment 52 is formed with an outwardly extending flange 51, which abuts against the flange 31 of the metal shield 3 and which is connected to the flange 31 of the metal shield 3. In this embodiment, the flange 51 is generally rectangular, and has four notches 513 formed in four peripheral corners thereof. The tongues 313 on the flange 31 of the metal shield 3 are bent to engage the notches 5113 in the flange 51 of the metal protective sleeve 5, thereby securing the metal shield 3 relative to the metal protective sleeve 5. Each of the flanges 31, 51 of the metal shield 3 and the metal protective sleeve 5 is formed with aligned pairs of through holes 311, 511 on two sides of the terminal opening 32. The sleeve wall further has a cylindrical rear end portion 54 that extends from the main body segment 52 and that permits extension of one end of the signal cable 8 into the metal protective sleeve 5.

The transparent insulating jacket 7, which encloses fittingly the metal protective sleeve 5, has basically the same overall configuration as the metal protective sleeve 5. In one embodiment, the transparent insulating jacket 7 is formed beforehand as an injection molded tubular plastic sleeve that can be stretched so as to be sleeved fittingly on the metal protective sleeve 5, with the metal shield 3 extending outwardly of the transparent plastic jacket 7. In another embodiment, the transparent insulating jacket 7 is formed by wrapping a thermoplastic material around the metal protective sleeve 5 and by subsequently shaping the thermoplastic material in a mold. Examples of plastic materials suitable for making the transparent plastic jacket 7 include PVC, PE, PC, PET and ABS. Accordingly, the transparent insulating jacket 7 includes a main body portion 76 and a tubular neck portion 78. The main body portion 76 has an inner wall surface 77 confronting an outer wall surface of the main body segment 52 of the sleeve wall of the metal protective sleeve 5. The neck portion 78 is connected integrally to the main body portion 76, and encloses the rear end portion 54 of the sleeve wall. Preferably, the main body portion 76 is formed with a flange 711 that surrounds the flange 51 of the metal protective sleeve 5. The main body portion 76 of the transparent insulating jacket 7 is further formed with two fastener holes 75, each of which is aligned with one of the pairs of the through holes 311, 511 in the metal shield 3 and the metal protective sleeve 5. A pair of fasteners 79 extend respectively through one of the fastener holes 75, one of the through holes 511 in the metal protective sleeve 5, and one of the through holes 311 in the metal shield 3 for securing the electrical connector to, e.g. a computer housing (not shown).

In this embodiment, the interlocking unit includes a hole set 551 formed in the top and bottom wall parts 55, 57 of the main body segment 52 of the sleeve wall of the metal protective sleeve 5, and a plug set 761 formed on the inner wall surface 77 of the main body portion 76 of the transparent insulating jacket 7. The plug set 761 engages the hole set 551 to interconnect securely the metal protective sleeve 5 and the transparent insulating jacket 7. Moreover, when the hole set 551 is registered with the rear coupling portions 252 of the pins 250 of the terminal set 25, the rear coupling portions 252 are visible externally of the metal protective sleeve 5 in view of the transparent characteristics of the insulating jacket 7. As such, it is possible to verify the connections between the terminal set 25 of the connector unit 1 and the signal lines 81 of the signal cable 8 in the electrical connector of this invention. Preferably, the interlocking unit further includes locking grooves 552 formed in the outer wall surface of the main body segment 52 of the sleeve wall of the metal protective sleeve S at the side wall parts 58, and locking ribs 762 formed on the inner wall surface 77 of the main body portion 76 of the transparent insulating jacket 7 to engage the locking grooves 552, thereby further enhancing the structural connection between the metal protective sleeve 5 and the transparent insulating jacket 7.

During assembly, after extending one end of the signal cable 8 through the metal protective sleeve 5, the signal lines 81 of the signal cable 8 can be connected electrically to the rear coupling portions 252 of the pins 250 of the terminal set 25 in a conventional manner. The pins 250 of the terminal set 25 can be mounted on the terminal holding member 2 before or after connecting the pins 250 to the signal lines 81 of the signal cable 8. Thereafter, the signal cable 8 is pulled so as to fit the terminal holding member 2 in the receiving space at the front end portion 53 of the main body segment 52 of the sleeve wall of the metal protective sleeve 5. At this time, the metal shield 3 can be disposed in front of the terminal holding member 2 such that the front mating portions 251 of the pins 250 of the terminal set 25 extend into the terminal opening 32 in the metal shield 3 and such that the through holes 311 in the metal shield 3 are aligned with the through holes 511 in the metal protective sleeve 5. After positioning the metal shield 3 relative to the metal protective sleeve 5, pressure is then applied to secure the terminal holding member 2 in the metal protective sleeve 5 and to bend the tongues 313 on the metal shield 3 for engaging the notches 513 in the metal protective sleeve 5, thereby securing the metal shield 3 to the metal protective sleeve 5.

Thereafter, the transparent insulating jacket 7 is disposed to enclose fittingly the metal protective sleeve 5. As mentioned hereinabove, the transparent insulating jacket 7 may be formed beforehand as an injection molded tubular plastic sleeve that can be stretched so as to be sleeved fittingly on the metal protective sleeve 5, or may be formed by wrapping a thermoplastic material around the metal protective sleeve 5 and by subsequently shaping the thermoplastic material in a mold. The interlocking unit constituted by the hole set 551 and the locking grooves 552 in the metal protective sleeve 5 and the plug set 761 and the locking ribs 762 on the transparent insulating jacket 7 ensure connection between the metal protective sleeve 5 and the transparent insulating jacket 7. Finally, the fasteners 79 are extended respectively through the fastener holes 75, the through holes 511 in the metal protective sleeve 5, and the through holes 311 in the metal shield 3.

The transparent insulating jacket 7 may be fabricated in different colors for ease of product identification and for aesthetic purposes. Additionally, relief patterns for the same purposes can be formed on the outer wall surface of the sleeve wall of the metal protective sleeve 5, such as by press casting, or on the inner wall surface 77 of the transparent insulating jacket 7, such as by hot stamping. Because the insulating jacket 7 is transparent, the relief patterns are visible externally of the insulating jacket 7. Moreover, because the relief patterns are not formed on the outer wall surface of the transparent insulating jacket 7, they can be protected from wearing and do not suffer from undesirably falling off from the insulating jacket 7 as commonly encountered when stickers are in use.

Figure 2:
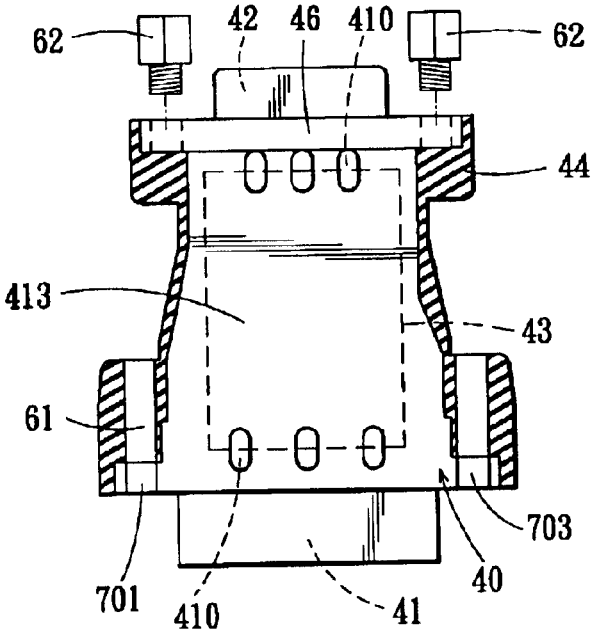
FIG. 2 is a partly sectional, schematic top view of the second preferred embodiment, in the form of an electrical adapter, according to this invention.
Figure 3:
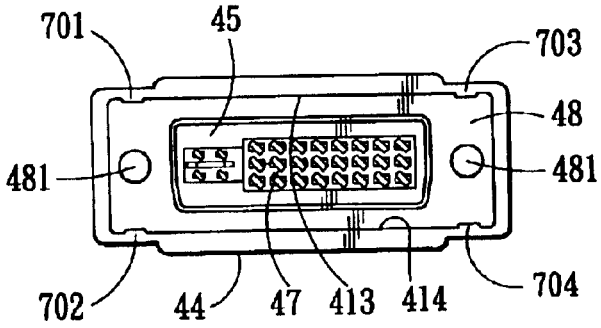
FIG. 3 is a schematic front view of the embodiment of FIG. 2.

Referring to FIGS. 2 and 3, the second preferred embodiment of this invention is shown to be embodied in an electrical adapter that includes a first connector unit 41, a second connector unit 42, an electrical coupling unit 43, and a connector housing constituted by a tubular unitary metal protective sleeve 40, a transparent insulating jacket 44, and an interlocking unit.

Each of the first and second connector units 41, 42 is similar to the connector unit 1 of the previous embodiment, and includes a terminal holding member 45 and a terminal set 47 mounted on the terminal holding member 45.

The electrical coupling unit 43, such as a printed circuit board, includes a first end portion and a second end portion. Printed conductive traces or paths extend between the first end portion and second end portion. The first end portion is coupled electrically to the rear coupling portions of the pins of the terminal set 47 of the first connector unit 41, whereas the second end portion is coupled electrically to the rear coupling portions of the pins of the terminal set 47 of the second connector unit 42.

The metal protective sleeve 40 has a sleeve wall that includes a top wall part 413, a bottom wall part 414, and a pair of opposite side wall parts 412 that interconnect the top and bottom wall parts 413, 414. The electrical coupling unit 43 is disposed in the sleeve wall, and the sleeve wall has a first wall portion that defines a first receiving space for receiving the terminal holding member 45 of the first connector unit 41 therein, and a second wall portion that defines a second receiving space for receiving the terminal holding member 45 of the second connector unit 42 therein. The first wall portion has a distal end formed with an outwardly extending first flange 48. The first flange 48 is formed with a pair of through holes 481. The second wall portion is formed with an outwardly extending second flange 46. The second flange 46 is formed with holes for receiving screws 62.

The transparent insulating jacket 44 encloses fittingly the metal protective sleeve 40, and is formed in a manner similar to the transparent insulating jacket 7 of the previous embodiment. The transparent insulating jacket 44 has an inner wall surface confronting the outer wall surface of the sleeve wall of the metal protective sleeve 40. The transparent insulating jacket 44 is formed with two fastener holes 61, each of which is aligned with one of the through holes 481 in the metal protective shield 40. The fastener holes 61 allow a set of fasteners (not shown) to extend respectively through the through holes 481 in the metal protective shield 40 for securing the electrical adapter to, e.g. a computer housing (not shown).

Like the previous embodiment, the interlocking unit includes a hole set 410 formed in the top wall part 413 of the metal protective sleeve 40, and a plug set formed on the inner wall surface of the transparent insulating jacket 44 to engage the hole set 410. In addition, locking grooves 701, 702, 703, 704 are formed in four corners of the first flange 48 of the metal protective sleeve 40. The locking grooves 701,702, 703,704 engage locking ribs on the inner wall surface of the transparent insulating jacket 44, thereby further securing interconnection between the metal protective sleeve 40 and the transparent plastic jacket 44, as best shown in FIG. 3.

Moreover, like the previous embodiment, relief patterns may be formed on either the outer wall surface of the sleeve wall of the metal protective sleeve 40, or on the inner wall surface 77 of the transparent insulating jacket 44.

Figure 4:
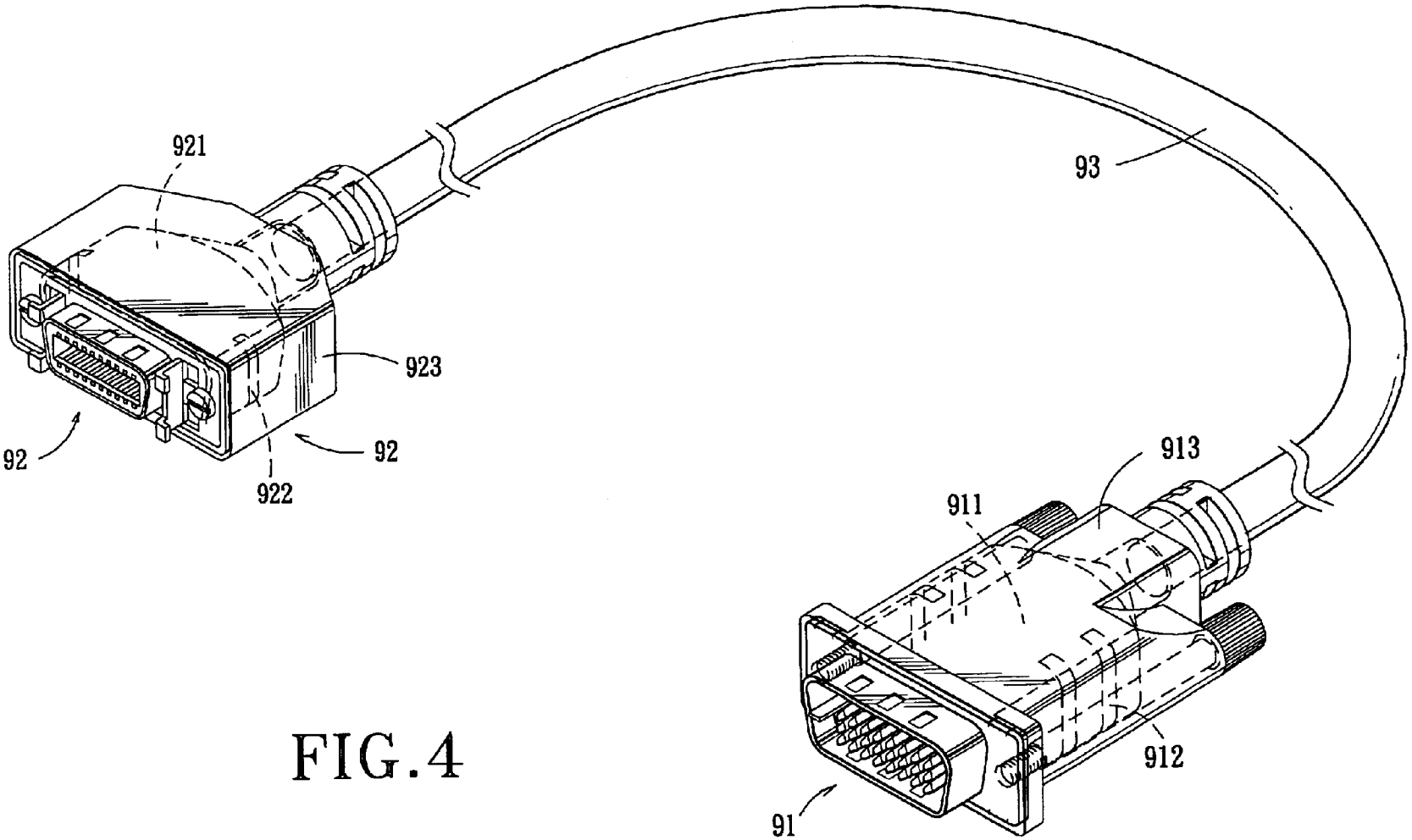
FIG. 4 is a perspective view of the third preferred embodiment, in the form of an electrical cable, according to this invention.

Referring to FIG. 4, the third preferred embodiment of this invention is shown to be embodied in an electrical cable that includes a first (male) electrical connector 91, a second (female) electrical connector 92, and a signal cable 93 having opposite ends terminated by the first and second electrical connectors 91, 92. The connection between each of the electrical connectors 91, 92 and the signal cable 93 is similar to that described hereinabove in connection with the first preferred embodiment. The electrical connectors 91, 92 differ primarily in their specifications. However, like the electrical connector of the first preferred embodiment, the connector housing of each of the first and second electrical connectors 91, 92 includes a tubular unitary metal protective sleeve 911, 921, a transparent insulating jacket 913, 923, and an interlocking unit 912, 922 for interconnecting securely the metal protective sleeve 911, 921 and the transparent insulating jacket 913, 923.

While the present invention has been described in connection with what is considered the most practical and preferred embodiments, it is understood that this invention is not limited to the disclosed embodiments but is intended to cover various arrangements included within the spirit and scope of the broadest interpretation so as to encompass all such modifications and equivalent arrangements.

I claim:

1. An electrical connector comprising:

a connector unit including a terminal holding member and a terminal set mounted on said terminal holding member, said terminal holding member having a front end face and a rear end face opposite to said front end face, said terminal set having a front mating portion and a rear coupling portion that projects rearwardly relative to said rear end face of said terminal holding member;

a tubular unitary metal protective sleeve having a sleeve wall with a front end portion that defines a receiving space for receiving said terminal holding member of said connector unit therein;

a transparent insulating jacket for enclosing fittingly said metal protective sleeve; and an interlocking unit including a hole set formed in one of said sleeve wall and said transparent insulating jacket and a plug set formed on the other of said sleeve wall and said transparent insulating jacket to interconnect securely said metal protective sleeve and said transparent insulating jacket.

2. The electrical connector as claimed in claim 1, wherein said hole set is formed in said sleeve wall, and said plug set is formed on said transparent insulating jacket, said hole set being registered with said rear coupling portion of said terminal set such that said rear coupling portion of said terminal set is visible externally of said metal protective sleeve.

3. The electrical connector as claimed in claim 1, wherein said sleeve wall and said transparent insulating jacket have confronting outer and inner wall surfaces, respectively, said interlocking unit further including a locking groove formed in one of said outer and inner wall surfaces of said sleeve wall and said transparent insulating jacket, and a locking rib formed on the other of said outer and inner wall surfaces of said sleeve wall and said transparent insulating jacket to engage said locking groove.

4. The electrical connector as claimed in claim 1, further comprising an annular metal shield that defines a terminal opening therein and that is disposed adjacent to said front end face of said terminal holding member, said metal shield having a rear end formed with an outwardly extending flange, said front mating portion of said terminal set projecting forwardly relative to said front end face of said terminal holding member and extending into said terminal opening in said metal shield.

5. The electrical connector as claimed in claim 4, wherein said sleeve wall has a distal front end formed with an outwardly extending flange that abuts against said flange of said metal shield and that is connected to said flange of said metal shield.

6. The electrical connector as claimed in claim 5, wherein said flange on one of said metal shield and said sleeve wall has a notched periphery, said flange on the other of said metal shield and said sleeve wall being formed with a tongue unit for engaging said notched periphery, thereby securing said metal shield to said metal protective sleeve.

7. The electrical connector as claimed in claim 5, wherein said flanges of said metal shield and said sleeve wall are formed with aligned pairs of through holes, said transparent insulating jacket being formed with a set of fastener holes, each of which is aligned with one of said pairs of said through holes, said electrical connector further comprising a set of fasteners, each of which extends through one of said fastener holes and one of said pairs of said through holes.

8. The electrical connector as claimed in claim 4, wherein said transparent insulating jacket is formed as a tubular plastic sleeve that is sleeved fittingly on said metal protective sleeve, said metal shield extending outwardly of said transparent insulating jacket.

9. The electrical connector as claimed in claim 1, wherein said transparent insulating jacket is formed by wrapping a thermoplastic material around said metal protective sleeve and shaping the thermoplastic material in a mold.

10. The electrical connector as claimed in claim 1, wherein said sleeve wall has an outer wall surface formed with a relief pattern that is visible externally of said transparent insulating jacket.

11. The electrical connector as claimed in claim 1, wherein said transparent insulating jacket has an inner wall surface that is formed with a relief pattern that is visible externally of said transparent insulating jacket.

12. An electrical adapter comprising:

first and second connector units, each of which includes a terminal holding member and a terminal set mounted on said terminal holding member, said terminal holding member having a first end face and a second end face opposite to said first end face, said terminal set having a mating portion and a coupling portion that projects relative to said second end face of said terminal holding member;

an electrical coupling unit having a first end portion coupled electrically to said coupling portion of said terminal set of said first connector unit, and a second end portion coupled electrically to said coupling portion of said terminal set of said second connector unit;

a tubular unitary metal protective sleeve having a sleeve wall with a first wall portion that defines a first receiving space for receiving said terminal holding member of said first connector unit therein, and a second wall portion that defines a second receiving space for receiving said terminal holding member of said second connector unit therein;

a transparent insulating jacket for enclosing fittingly said metal protective sleeve; and an interlocking unit including a hole set formed in one of said sleeve wall and said transparent insulating jacket and a plug set formed on the other of said sleeve wall and said transparent insulating jacket to interconnect securely said metal protective sleeve and said transparent insulating jacket.

13. The electrical adapter as claimed in claim 12, wherein said sleeve wall and said transparent insulating jacket have confronting outer and inner wall surfaces, respectively, said interlocking unit further including a locking groove formed in one of said outer and inner wall surfaces of said sleeve wall and said transparent insulating jacket, and a locking rib formed on the other of said outer and inner wall surfaces of said sleeve wall and said transparent insulating jacket to engage said locking groove.

14. The electrical adapter as claimed in claim 12, wherein said transparent insulating jacket is formed as a tubular plastic sleeve that is sleeved fittingly on said metal protective sleeve.

15. The electrical adapter as claimed in claim 12, wherein said transparent insulating jacket is formed by wrapping a thermoplastic material around said metal protective sleeve and shaping the thermoplastic material in a mold.

16. The electrical adapter as claimed in claim 12, wherein said sleeve wall has an outer wall surface formed with a relief pattern that is visible externally of said transparent insulating jacket.

17. The electrical adapter as claimed in claim 12, wherein said transparent insulating jacket has an inner wall surface that is formed with a relief pattern that is visible externally of said transparent insulating jacket.

18. An electrical cable comprising:

a connector unit including a terminal holding member and a terminal set mounted on said terminal holding member, said terminal holding member having a first end face and a second end face opposite to said first end face, said terminal set having a mating portion and a coupling portion that projects relative to said second end face of said terminal holding member;

a signal cable having a first cable portion coupled electrically to said coupling portion of said terminal set, and a second cable portion opposite to said first cable portion;

a tubular unitary metal protective sleeve having a sleeve wall with a first wall portion that defines a receiving space for receiving said terminal holding member therein, and a second wall portion that defines an opening to permit said second cable portion of said signal cable to extend out of said metal protective sleeve;

a transparent insulating jacket for enclosing fittingly said metal protective sleeve; and an interlocking unit including a hole set formed in one of said sleeve wall and said transparent insulating jacket and a plug set formed on the other of said sleeve wall and said transparent insulating jacket to interconnect securely said metal protective sleeve and said transparent insulating jacket.

19. The electrical cable as claimed in claim 18, wherein said sleeve wall and said transparent insulating jacket have confronting outer and inner wall surfaces, respectively, said interlocking unit further including a locking groove formed in one of said outer and inner wall surfaces of said sleeve wall and said transparent insulating jacket, and a locking rib formed on the other of said outer and inner wall surfaces of said sleeve wall and said transparent insulating jacket to engage said locking groove.

20. The electrical cable as claimed in claim 18, wherein said transparent insulating jacket is formed as a tubular plastic sleeve that is sleeved fittingly on said metal protective sleeve.

21. The electrical cable as claimed in claim 18, wherein said transparent insulating jacket is formed by wrapping a thermoplastic material around said metal protective sleeve and shaping the thermoplastic material in a mold.

22. The electrical cable as claimed in claim 18, wherein said sleeve wall has an outer wall surface formed with a relief pattern that is visible externally of said transparent insulating jacket.

23. The electrical cable as claimed in claim 18, wherein said transparent insulating jacket has an inner wall surface that is formed with a relief pattern that is visible externally of said transparent insulating jacket.

24. A connector housing comprising:

a tubular unitary metal protective sleeve;

a transparent insulating jacket for enclosing fittingly said metal protective sleeve; and an interlocking unit including a hole set formed in one of said metal protective sleeve and said transparent insulating jacket, and a plug set formed on the other of said metal protective sleeve and said transparent insulating jacket to interconnect securely said metal protective sleeve and said transparent insulating jacket.

25. The connector housing as claimed in claim 24, wherein said metal protective sleeve and said transparent insulating jacket have confronting outer and inner wall surfaces, respectively, said interlocking unit further including a locking groove formed in one of said outer and inner wall surfaces of said metal protective sleeve and said transparent insulating jacket, and a locking rib formed on the other of said outer and inner wall surfaces of said metal protective sleeve and said transparent insulating jacket to engage said locking groove.

26. The connector housing as claimed in claim 24, wherein said transparent insulating jacket is formed by wrapping a thermoplastic material around said metal protective sleeve and shaping the thermoplastic material in a mold.

27. The connector housing as claimed in claim 24, wherein said metal protective sleeve has an outer wall surface formed with a relief pattern that is visible externally of said transparent insulating jacket.

28. The connector housing as claimed in claim 24, wherein said transparent insulating jacket has an inner wall surface that is formed with a relief pattern that is visible externally of said transparent insulating jacket.

* * * * *